US005769141A

United States Patent [19]

Rinehard

[11] Patent Number: 5,769,141

[45] Date of Patent: Jun. 23, 1998

[54] COMBINATION GOLF CLUB HEAD COVER AND GOLF TOWEL

[76] Inventor: Gary F. Rinehard, 1024 Climburg Rose Turn, Cary, N.C. 27511

[21] Appl. No.: 850,797

[22] Filed: May 2, 1997

[51] Int. Cl.[6] ..... A63B 57/00

[52] U.S. Cl. ..... 150/160; 206/315.4

[58] Field of Search ..... 150/159, 160; 206/315.3, 315.4

[56] References Cited

U.S. PATENT DOCUMENTS

| | | | |
|---|---|---|---|
| 2,526,985 | 10/1950 | Whitehead | 150/160 |
| 2,532,195 | 11/1950 | Rosenow et al. | 150/160 |
| 3,831,652 | 8/1974 | Hyden et al. | 150/160 |
| 3,938,570 | 2/1976 | Stewart | 150/160 |
| 5,284,194 | 2/1994 | Gaffney | 150/160 |
| 5,394,914 | 3/1995 | Meek | 150/160 |

*Primary Examiner*—Sue A. Weaver
*Attorney, Agent, or Firm*—Rhodes, Coats & Bennett, L.L.P.

[57] ABSTRACT

The present invention entails a golf club head cover section integrally constructed with a towel section. The golf club head cover section comprises a stretchable enclosure that is enclosed about one end and about a surrounding side wall. An opening is formed in the head cover section opposite the closed end. Secured to the opening of the head cover section is the towel section. A connecting edge of the towel section is stitched or sewn around the opening of the head cover section. The towel section includes a free end that forms a lower opening and also the towel section includes a pair of opposed side edges that are left substantially unattached so as to form an elongated slit down the side of the towel section.

17 Claims, 5 Drawing Sheets

COMBINATION GOLF CLUB HEAD COVER AND GOLF TOWEL

FIELD OF THE INVENTION

The present invention relates to golf accessories and more particularly to golf club head covers and golf towels, and still more particularly to a combination golf club head cover and golf towel.

BACKGROUND OF THE INVENTION

It is seldom that one sees a golf bag that does not have a series of head covers disposed over certain clubs within the bag and a separate golf towel clipped to the side of the golf bag. These two golf accessories, that is head covers and golf towels, are quite functional and are important accessories carried by every serious golfer.

However, individual head covers and golf towels are not without their disadvantages and drawbacks. For example, head covers are sometimes difficult to put on and take off. Moreover, golfers tend to lose head covers during the course of a round of golf. As pointed out above, golf towels are a necessity for the serious golfer. They are used to clean golf balls and clubs after, before and during play, and are sometimes used personally by the golfer to wipe sweat and perspiration. In some cases, during a round of golf, a golfer may have to repeatedly unclip the golf towel from the bag and reclip the same golf towel back to the golf bag. This can be time consuming, frustrating and detracting to the golfer. In addition, the golfer often finds that he or she is in need of a golf towel and yet the golf towel is clipped to a golf bag that is on a golf cart that might be as far away as 50 yards. In such cases, the golfer is prone to proceed without cleaning his or her ball or club because to retrieve the golf towel would, in many cases, impose delay.

There have been attempts at designing a single device that functions as a head cover and as a golf towel. See, for example, the disclosure found in U.S. Pat. No. 5,394,914. In this patent, the device is designed to cover a putter and serves as a towel or wipe. The combination device is basically a sheet of fabric or material that includes Velcro strips strategically placed about the material that enables the sheet of material to be folded and secured together so as to form a hood or cover around the head of a putter with the remaining portion of the material draping down from the club head to serve as a wiper. This device, while attempting to serve two functions, still includes inherent disadvantages. First, the combination club head cover and wiper requires that the device be repeatedly fastened and unfastened. Further, the device is not fabricated such that it can simply be slipped over a golf club head. In addition, as shown in U.S. Pat. No. 5,394,914, the combination head cover and wiper even when disposed about the putter, hangs downwardly in an awkward and unflattering posture.

Therefore, there has been and continues to be a need for a combination golf club head cover and golf towel that provides one single structure or device that acts as a head cover and as a golf towel and which is easy to use for both of its primary functions and which is designed to be used in such a way that the single device or structure is readily available to the golfer at all times during the course of a golf round.

SUMMARY AND OBJECTS OF THE INVENTION

The present invention entails a combination golf club head cover and golf towel that is designed to overcome the drawbacks and disadvantages associated with individual head covers and towels as well as shortcomings associated with combination golf club head covers and golf towels of the prior art.

The combination head cover and golf towel of the present invention comprises a head cover section and a towel section joined together to form an integral construction. The head cover section comprises a closed end, a closed surrounding side, and an open end opposite the closed end. The towel section is in turn secured around the opening of the head cover section and depends or extends therefrom. More particularly, the towel section includes a connecting edge that is sewn, stitched or otherwise connected around a substantial portion of the opening of the head cover section. Once the combination head cover and golf towel is disposed over the head of a golf club, the towel section depends downwardly from the head cover section and generally wraps around a portion of a shaft that extends from the covered head portion. The towel section while generally assuming a draping and wraparound configuration is still open in order that it can be readily used even while suspended from a golf club and hanging just outside a golf bag. In the suspended or draped position, the towel section includes an elongated slit that extends vertically, with the slit being essentially formed by two spaced apart edges of the towel. In addition, the towel includes a free end, opposite the end connected to the head cover section, that is also generally open.

It is therefore an object of the present invention to provide a combination golf club head cover and golf towel that is easy to use and which is attractive.

A further object of the present invention resides in the provision of a combination head cover and golf towel wherein the golf towel can be utilized while the device is secured about a club within a golf bag.

Another further object of the present invention is to provide a combination golf club head cover and golf towel that is of a design that is capable of carrying advertisements, club emblems, and other indicia.

Still a further object of the present invention resides in the provision of a combination golf club head cover and golf towel that is relatively simple in design and easy to manufacture.

It is also an object of the present invention to provide a combination head cover and golf towel that is not bulky but which is compact and does not clutter the golf bag when disposed over one or more golf clubs.

Other objects and advantages of the present invention will become apparent and obvious from a study of the following description and the accompanying drawings which are merely illustrative of such invention.

DETAILED DESCRIPTION OF THE INVENTION

Figure 1:
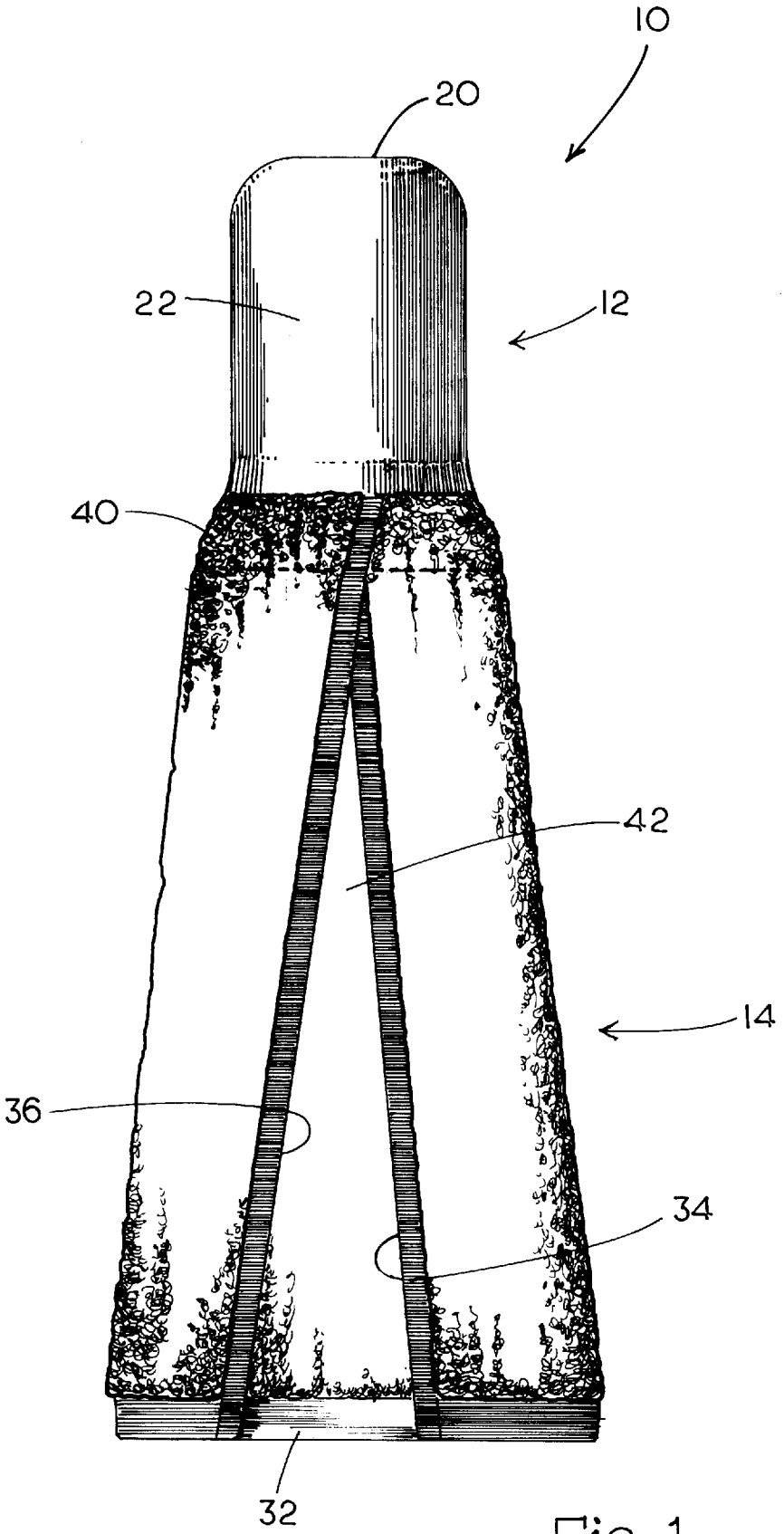
FIG. 1 is a side elevational view of the combination golf club head cover and golf towel.
Figure 2:
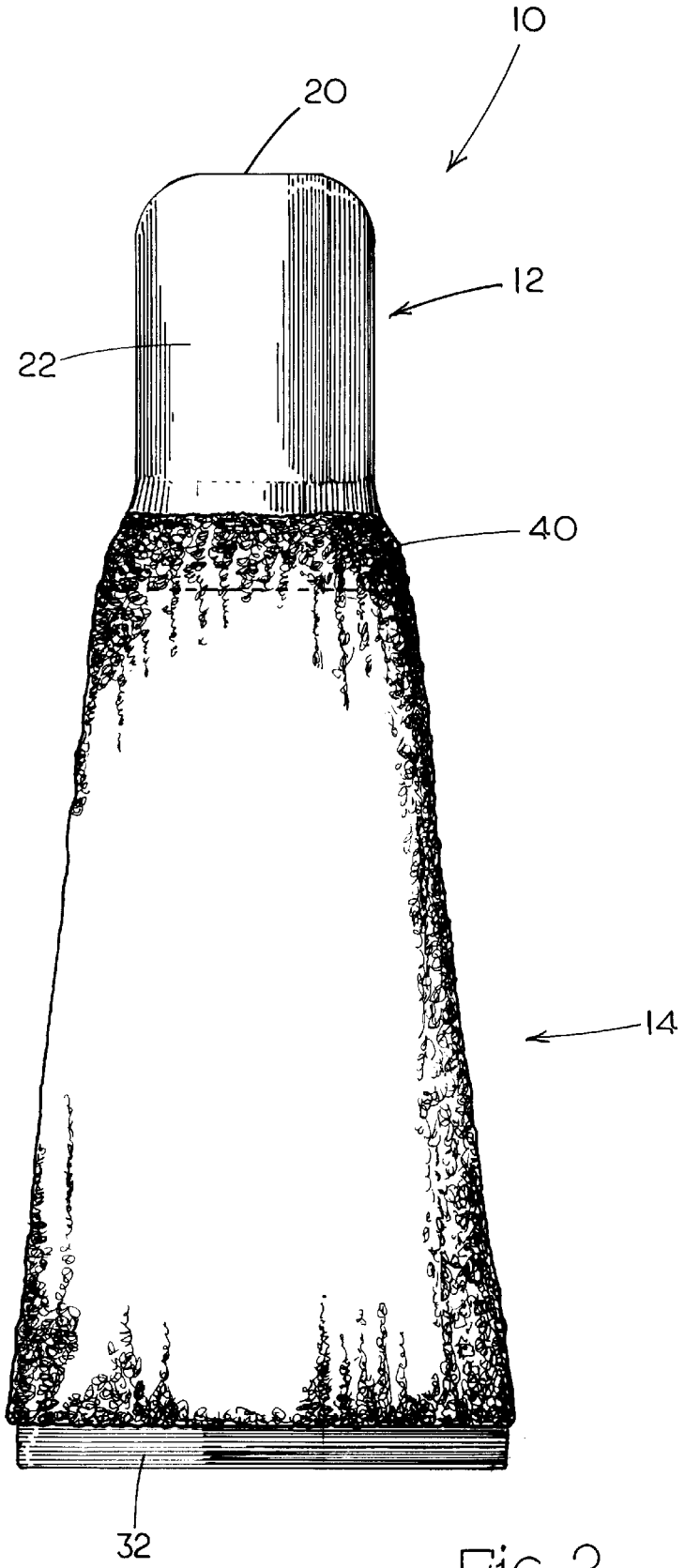
FIG. 2 is another side elevational view of the combination golf club head cover and golf towel, viewed from the side opposite that shown in FIG. 1.
Figure 3:
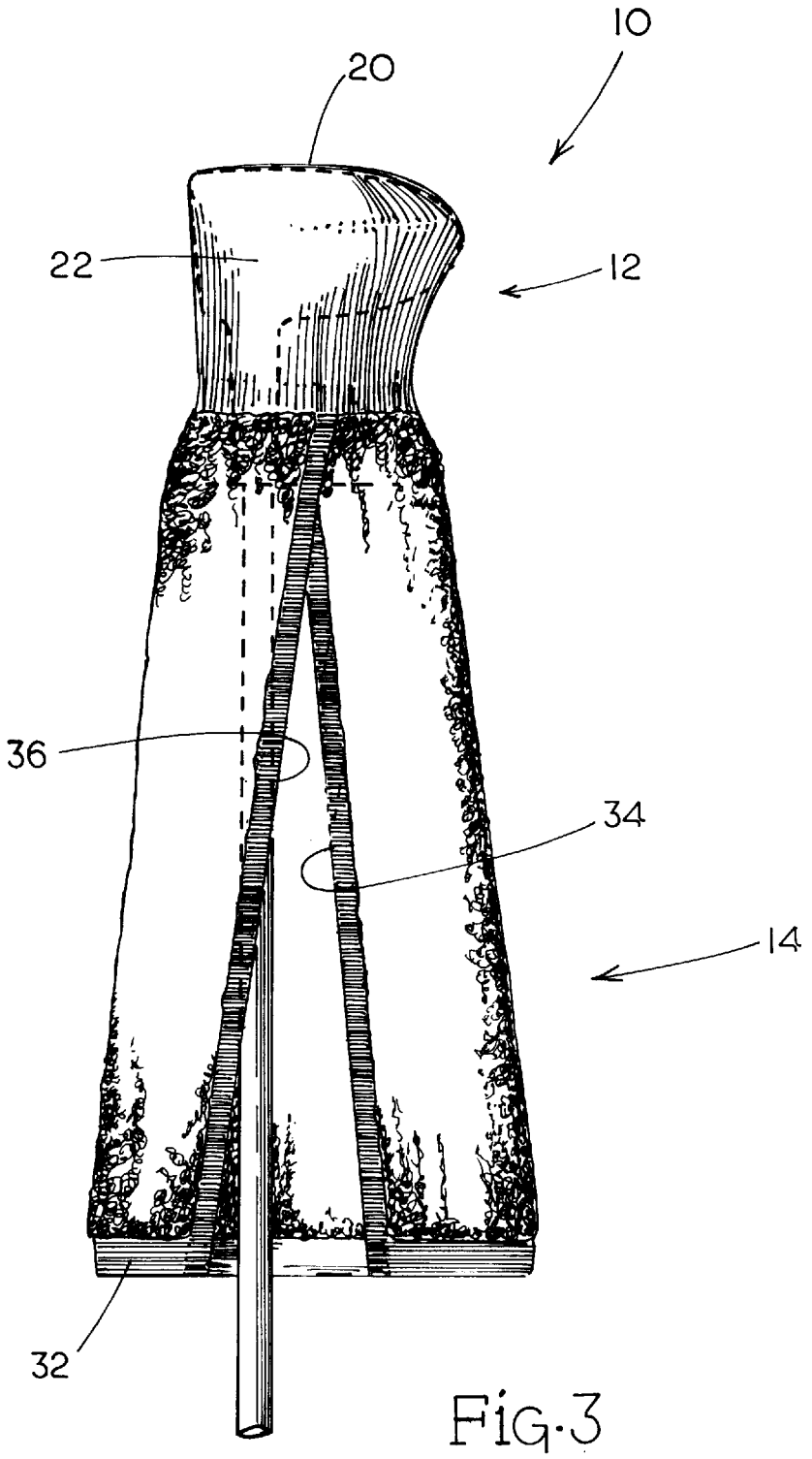
FIG. 3 is a side elevational view of the combination golf club head cover and golf towel showing a golf club being inserted therein.

With further reference to the drawings, the combination golf club head cover and golf towel is shown therein and indicated generally by the numeral 10. The combination head cover and golf towel basically comprises a head cover section indicated generally by the numeral 12 and a towel section indicated generally by the numeral 14. As will be appreciated from further discussions, the head cover section 12 and the towel section 14 are integrally constructed to form a single piece golf accessory. As seen in FIGS. 1–3, the combination head cover and golf towel 10 is generally elongated when the same assumes a position secured onto a golf club.

Various types of materials can be used to construct the combination head cover and golf towel 10. It is appreciated that the material utilized should be pliable and soft. While the materials used to construct the head cover section 12 and towel section 14 could be the same, it is contemplated that in one embodiment of the present invention that the material utilized for the head cover section 12 would be different than the material used for the towel section 14. In the way of an example, it is contemplated that the head cover section 12 could be constructed of a stretchable knit-type or fleece material that could easily be stretched and conformed around the head portion of a golf club. The towel section 14 on the other hand, could be constructed of basic towel materials having good absorbent qualities such as terrycloth. It will be appreciated, however, by those ordinarily skilled in the art, that a wide range of materials can be used for either the head cover section 12 and the towel section 14.

Turning to a discussion of the head cover section 12, it is seen that the same includes a closed upper end 20 and a closed surrounding side 22. Formed about the end of the head section 12 opposite the closed end 20 is an opening 26 that is sometimes referred to as a club head opening. In fact, the lower edge of the surrounding side 22 is referred to as a terminal edge 24 and this terminal edge essentially defines the club head opening 26. (See FIG. 4).

As noted above, the towel section 14 is integrally connected to the head cover section 12. The towel section 14, for purposes of reference, includes an upper connecting edge 30 and a lower free end 32. In addition, the towel section 14 includes a pair of opposed side edges 34 and 36. These opposed side edges 34 and 36 define an elongated slit 42 (FIG. 2) that extends from an area adjacent to where the towel section 14 joins the head cover section 12 to the lower free end 32 of the towel section.

Figure 4:
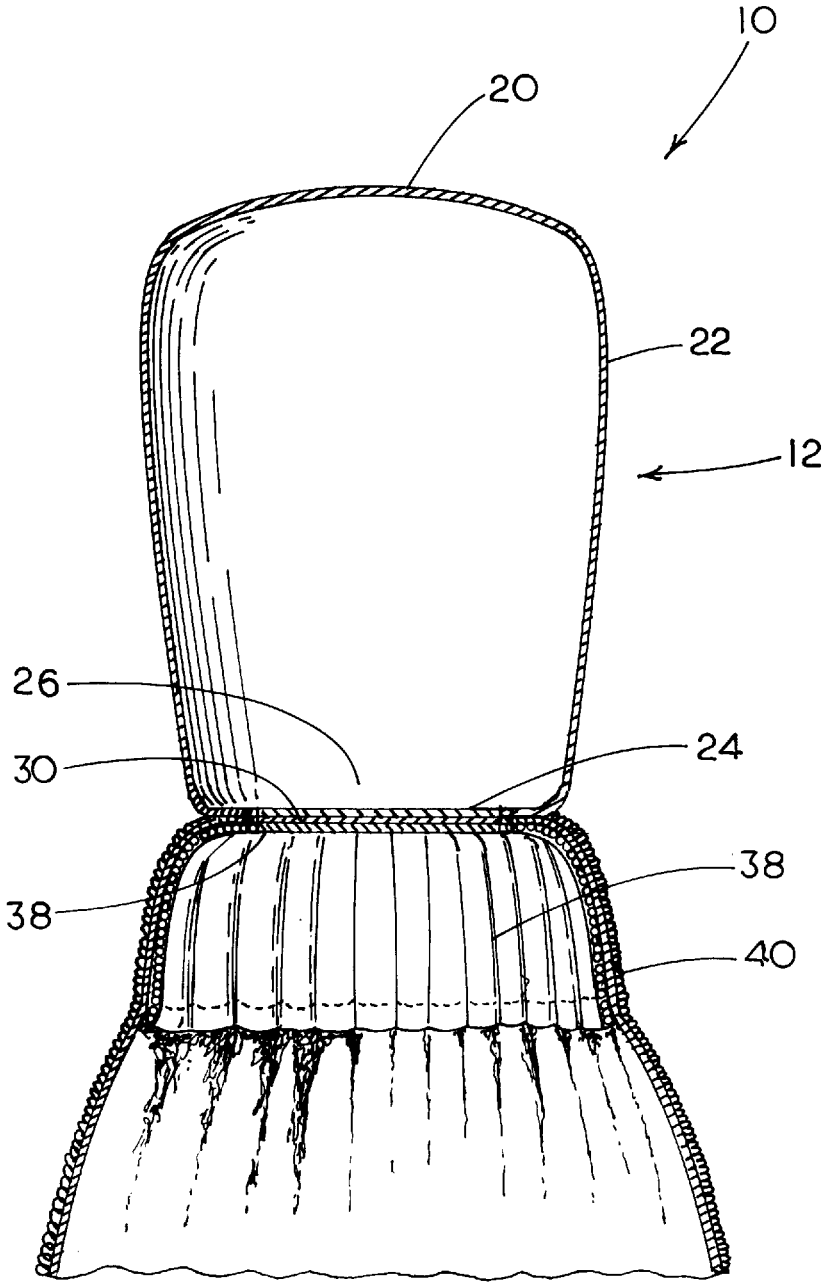
FIG. 4 is a longitudinal sectional view of the combination golf club head cover and golf towel.
Figure 5:
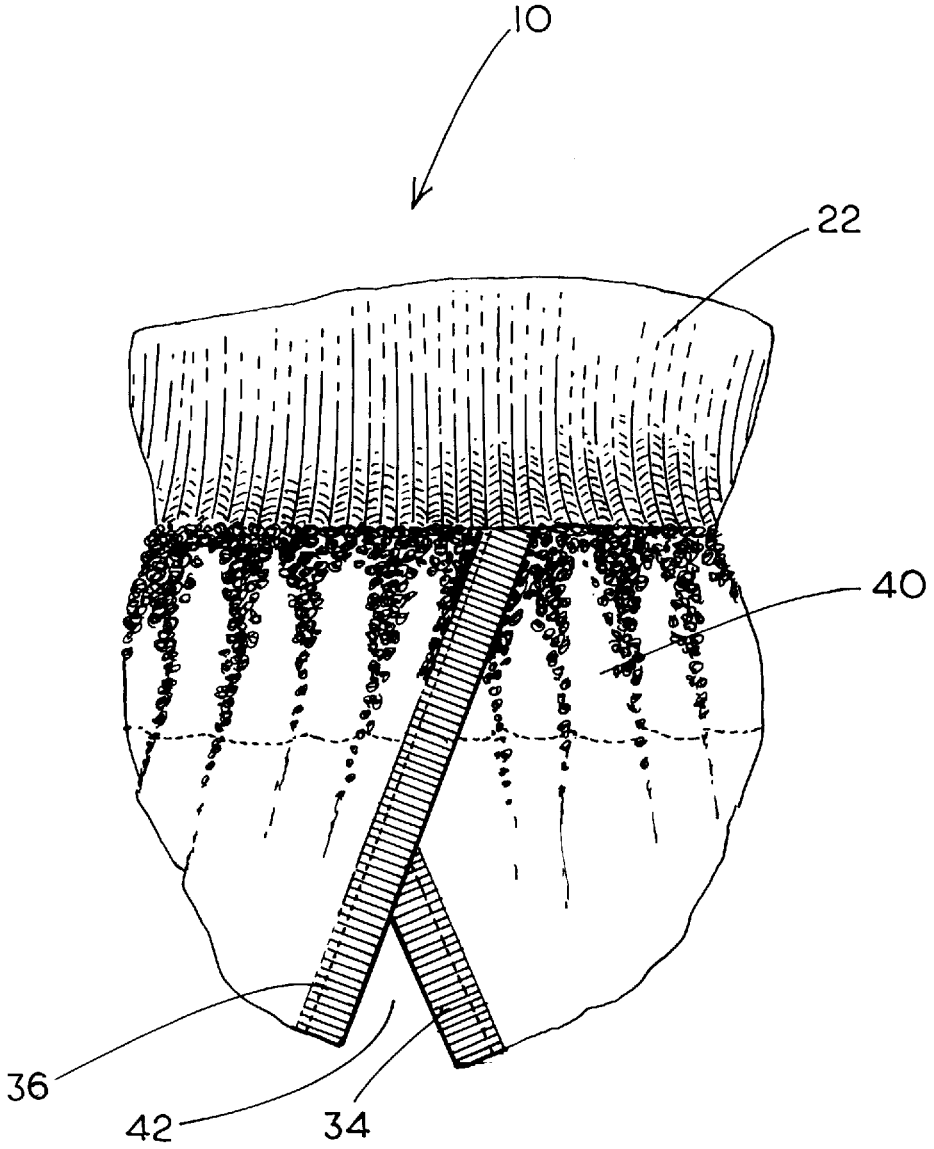
FIG. 5 is a fragmentary view illustrating an area where the head cover section joins the towel section.

With particular reference to FIG. 4, note that the connecting edge 30 of the towel section 14 is laid adjacent the terminal edge 24 of the surrounding side 22 of the head cover section 12. Thereafter, the connecting edge 30 and the terminal edge 24 are stitched together to form an internal seam that extends around an interior area of the head cover and golf towel 10. It should be appreciated that other types of seams and connecting techniques can be used to secure the head cover section 12 to the towel section 14.

As seen in the drawings, an upper portion of the towel section 14, adjacent the area where the same joins the head cover section 12, is formed into a gathered segment or band 40 that extends around the towel section and is referred to by the numeral 40. Secured to the back side of the towel section 14 adjacent the gathered band 40 is an elastic band 38. The elastic band 38 is stitched or otherwise secured to the gathered band 40. It should also be noted that the same stitch pattern that connects the connecting edge 30 with the terminal edge 24 could be utilized to secure, at least in part, the elastic band 38 to the gathered band or segment 40. Thus, it is appreciated that the elastic strip or band 38 in combination with the gathered band or segment 40 provides an expandable and retractable circumference that enables a golf club head portion to be easily passed therethrough but also acts to generally contract this area so as to form a neat and firm fit around the club head.

As seen in the drawings, the towel section 12 forms a generally flared wrap around as it extends from the head cover section 12. Note that in the design illustrated herein that the towel section tends to flare outwardly towards its free end 32. In the design illustrated, however, note that the opposed side edges 34 and 36 are overlapped and stitched adjacent the gathered band 40.

In use, the combination head cover and golf towel 10 is pulled downwardly over any selected club to where the head portion of the club is inserted within the head cover section 12. See FIG. 3. In this position, the shaft portion of the club extends downwardly through the towel section 14 that generally forms a wrap-around configuration about a portion of the shaft. As seen in the drawings, in a normal hanging position, the head cover section 12 and the towel section 14 are generally aligned. However, when disposed on a golf club held within a golf bag, the towel section 14 can be directed to fall or drape outside of the bag. Typically, the towel section 14 will be suspended or hung from the head portion of a club such that it extends downwardly adjacent an exterior side of the bag, thereby being readily accessible to the golfer for cleaning and wiping clubs or golf balls.

In addition, the combination head cover and golf towel 10 can be removed from the bag area by the golfer and taken to a green or any other area remote from the golfer's bag. The configuration of the towel section 14 makes it extremely convenient and easy to use for wiping clubs and cleaning golf balls or other equipment. The slit 42 formed in the towel section 12 enables the golfer to conveniently insert his or her club into the interior confines of the towel section 12 for cleaning. Thus, both the interior and exterior areas of the towel section are readily accessible to the golfer.

Another advantage of the combination head cover and golf towel 10 of the present invention is that the integral construction assures that the towel is always coupled to the head cover section 12. This should reduce the incidents of head covers and towels being lost during the course of a golf round.

It is also appreciated that the combination device, that is the combined head cover and towel, provides a convenient and conspicuous medium for advertising or for carrying club emblems or logos thereon.

In the end, the combination club head and golf towel 10 provides two important functions in a single device, namely that of protecting the head portions of golf clubs and providing a towel for personal use and for cleaning and wiping golf balls and golf clubs, shoes and other equipment.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A combination golf club head cover and golf towel comprising: a head cover section including a closed end and a surrounding side having an outer terminal edge portion that forms a club head opening through which a club head passes as it is inserted into the head cover section; an integral towel section secured to the club head opening of the head cover section and extending therefrom; the towel section including a connecting end portion, a free end portion, and a pair of opposed side edge portions; wherein the connecting end portion of the towel section is connected to the terminal edge portion of the head cover section in such a fashion that the towel section forms a wrap around having an elongated slit, defined by the pair of side edge portions of the towel section, that extends from adjacent the club head opening of the head cover section to the free end portion of the towel section; and wherein the pair of side edges of the towel section are secured together and overlapped for a relatively short segment adjacent the area where the club head cover section and the towel section join.

2. The combination club head cover and golf towel of claim 1 wherein the club head section and the towel section are made from two different materials.

3. The combination club head cover and golf towel of claim 2 wherein the head cover section is formed of a stretchable material.

4. The combination club head cover and golf towel of claim 1 including a gathered segment that extends around the combination club head cover and towel section in the area where the club head cover section and towel section join.

5. The combination club head cover and golf towel of claim 4 including an elastic strip secured adjacent to the gathered segment.

6. The combination club head cover and golf towel of claim 5 wherein the gathered segment is formed in the towel section and is formed adjacent the club head opening formed in the head cover section.

7. The combination club head cover and golf towel of claim 1 wherein the head cover section is closed except for the club head opening.

8. The combination club head cover and golf towel of claim 1 wherein the head cover section and towel section are longitudinally aligned such that when the head cover section is pulled over a golf club head the towel section tends to hang from the head cover section and to generally wrap around a portion of a shaft extending from the golf club head and wherein the head cover section includes a central axis that extends generally downwardly within the confines of the hanging and wrapped around towel section.

9. The combination club head cover and golf towel of claim 1 wherein the outer terminal edge of the head cover section and the connecting end portion of the towel section are laid adjacent each other and stitched to form a surrounding seam; and wherein a segment of the towel section adjacent the seam is gathered and an elastic band is stitched to a back side of the gathered segment of the towel section.

10. The combination club head cover and golf towel of claim 9 wherein the opposite side edge portions overlap and are stitched together in the area of the gathered segment, but wherein the opposed side edge portions are unattached in an area spaced from the gathered segment so as to form the elongated slit in the towel section.

11. A combination club head cover and golf towel comprising an integral head cover section and a towel section that is adapted to be fitted over the head portion of a golf club such that the head cover section covers the head portion of the golf club and the towel section hangs from the head cover section and wraps around a portion of a shaft that extends from the head portion; the head cover section including a closed end, a closed surrounding side, and an opening defined opposite the closed end; the towel section including a connecting end, a free end, and a pair of opposed side edges; the connecting end of the towel section being connected to the opening of the head cover section in such a fashion that the connecting edge extends around the opening and forms a substantially closed band adjacent the opening of the head cover section; and wherein the pair of side edges of the towel section are secured together and overlap adjacent the area where the club head cover section and the towel section join and wherein the opposed side edges of the towel section below the area of overlapment are left unattached so as to define an open slit in the towel section such that when the combination golf club head cover and golf towel is placed on a golf club, the towel section is generally aligned with the head cover and assumes a generally wrap-around configuration that is opened around the free end of the towel and is also open along the side of the towel section by the elongated slit defined by the opposed side edges.

12. The combination club head cover and golf towel of claim 11 wherein the head cover section and the towel section are formed of different materials.

13. The combination club head cover and golf towel of claim 12 wherein the head cover section comprises a stretchable material that tends to conform to the shape of the head portion of the golf club.

14. The combination club head cover and golf towel of claim 11 wherein in a normal hanging position the towel section forms an elongated wrap around that is generally flared at least slightly outwardly from the area where the towel section joins the head cover section to the free end of the towel section.

15. The combination club head cover and golf towel of claim 11 wherein the towel section includes a gathered segment formed around a substantial portion of the combination club head cover and towel just below the opening of the head cover section.

16. The combination club head cover and golf towel of claim 15 including an elastic band secured to a back side of the towel section adjacent the gathered segment so as to form an expandable segment around the combination golf club head cover and golf towel intermediately between the head cover section and the free of the towel section.

17. The combination club head cover and golf towel of claim 16 wherein the opening of the head cover section includes a surrounding terminal edge and wherein that terminal edge is stitched to the connecting end of the towel section adjacent the gathered segment.

* * * * *